United States Patent [19]

Iwase et al.

[11] Patent Number: 4,911,949

[45] Date of Patent: Mar. 27, 1990

[54] METHOD FOR COATING METAL PART WITH SYNTHETIC RESIN INCLUDING POST COATING STEP FOR HEATING COATED PART TO ELEMINATE VOIDS

[75] Inventors: Takahiro Iwase, Anjyo; Naofumi Masuda, Nagoya; Hiroyuki Mochizuki, Aichi; Shigenori Tamaki; Nobuo Kabayashi, both of Toyota, all of Japan

[73] Assignee: Toyota Jidosha Kabushiki Kaisha, Toyota, Japan

[21] Appl. No.: 900,636

[22] Filed: Aug. 27, 1986

[51] Int. Cl.[4] ..... B05D 3/14

[52] U.S. Cl. ..... 427/46; 427/185; 427/195; 118/DIG. 5

[58] Field of Search ..... 427/46, 195, 185; 118/DIG. 5

[56] References Cited

U.S. PATENT DOCUMENTS

| | | | |
|---|---|---|---|
| 2,974,059 | 3/1961 | Gemmer | 427/185 |
| 2,974,060 | 3/1961 | Dettling | 427/185 |
| 3,063,860 | 11/1962 | Gemmer | 427/195 X |
| 3,090,696 | 5/1963 | Gemmer | 427/185 |
| 3,183,113 | 5/1965 | Gemmer | 427/185 |
| 3,261,707 | 7/1966 | Korski et al. | 118/DIG. 5 |
| 3,282,249 | 11/1966 | Ramsay | 118/DIG. 5 |
| 3,383,233 | 5/1968 | Curcio | 427/185 X |
| 3,419,409 | 12/1968 | Dettling | 427/185 |
| 3,431,887 | 3/1969 | Pettigrew et al. | 118/DIG. 5 |
| 3,514,308 | 5/1970 | Scott et al. | 427/185 |
| 3,925,570 | 12/1975 | Reinke et al. | 427/46 |
| 3,959,525 | 5/1976 | Sentementes et al. | 427/185 |
| 3,985,097 | 10/1976 | Sitton | 427/185 X |
| 4,466,989 | 8/1984 | Haller et al. | 427/185 |
| 4,693,813 | 9/1987 | Takeshita et al. | 409/244 |

FOREIGN PATENT DOCUMENTS

| | | | |
|---|---|---|---|
| 682664 | 3/1964 | Canada | 427/185 |
| 60-238185 | 11/1985 | Japan . | |
| 61-181567 | 8/1986 | Japan . | |
| 61-181571 | 8/1986 | Japan . | |
| 61-181572 | 8/1986 | Japan . | |
| 61-187975 | 8/1986 | Japan . | |

OTHER PUBLICATIONS

PTO-88-0103, English translation to Japanese Kokai Pat. No. 60-238185.

Stott, Louis L., "Fluidized Bed Method of Coating", Organic Finishing (Jun. 1956), pp. 16-17.

"Powder Coating", Products Finishing (Oct. 1970), pp. 70-77.

SAE Technical Paper Series, #860101 "Development of Volkswagen's Supercharger G-Lader", B. Wiedemann, H. Leptien, G. Stolle, K. D. Emmenthal.

*Primary Examiner*—Shrive Beck

*Assistant Examiner*—Alain Bashore

*Attorney, Agent, or Firm*—Oblon, Spivak, McClelland, Maier & Neustadt

[57] ABSTRACT

A method of applying a synthetic resin layer to an outer surface of a metal part, comprising heating the metal part to a temperature higher than a melting point of a synthetic resin, embedding the heated metal part within a powdered mass of the synthetic resin, thereby melting a portion of the powdered mass surrounding the outer surface of the heated melt part, holding the heated metal part within the powdered mass for a time period sufficient to permit the molten portion of the powdered mass to be coated on the outer surface of the heated metal part as the synthetic resin layer, removing the metal part coated with the synthetic resin layer from the powdered mass, and maintaining the removed metal part at a temperature higher than the melting point and lower than a thermal decomposition point of the synthetic resin, to hold the deposited resin layer in a molten state for a suitable length of time, in order to allow the escape of possibly entrapped air from the resin layer.

13 Claims, 3 Drawing Sheets

METHOD FOR COATING METAL PART WITH SYNTHETIC RESIN INCLUDING POST COATING STEP FOR HEATING COATED PART TO ELEMINATE VOIDS

BACKGROUND OF THE INVENTION

1. Field of the Art

The present invention relates in general to a method for coating a metal part with a synthetic resin material, and more particularly to improvements in the art of applying a resin layer to an outer surface of a metallic core member to produce a resin-coated metal part, by positioning the core member heated to an elevated temperature within a powdered mass of a thermally fusible resin.

2. Description of Related Art

Various resin-coated metal parts are known. FIG. 5 shows an example of such resin-coated metal parts in the form of a pair of lobe-type rotors 4 for a rotary fluid machine of a Roots type such as a supercharger used on an engine of an automotive vehicle to increase volumetric efficiency by forcing a greater quantity of air into the cylinders. The supercharger has a housing which consists of a hollow housing body 2, and a pair of end plates (not shown) which close opposite open ends of the hollow housing body 2, and cooperate with the hollow housing body 2 to define an air-tight pump chamber 3. The housing rotatably supports a pair of parallel support shafts 6, 6 which support the corresponding lobe-type rotors 4, 4 accommodated in the pump chamber 3. The two lobe-type rotors 4, 4 are coupled to each other by a pair of timing gears (not shown) fixed to one end of the corresponding support shafts 6, 6, so that the two rotors 4, 4 are rotated in opposite directions at the same angular velocity, whereby air is sucked into the pump chamber 3 through an inlet 8 formed in the housing body 2, and the compressed air is discharged from the pump chamber 3 through an outlet 10 also formed in the housing body 2.

Each lobe-type rotor 4, 4 consists of a metallic core member 11 and a resin layer 12 of a suitable thickness which covers an outer peripheral surface and opposite end faces of the core member 11. The resin layer 12 is applied to minimize gaps between the two rotors 4, 4, and between the rotors 4, 4 and the inner surface of the housing body 2, and to thereby improve the volumetric efficiency of the supercharger. The core member 11 consists of a pair of lobes, and has a transverse cross sectional shape similar to the shape of a cocoon or peanut shell.

For applying such a synthetic resin coating (hereinafter called "resin layer") to the outer surface of a metallic core member, the present applicants have attempted to practice a method wherein the metallic core member is heated to a temperature higher than a melting point of a thermally fusible synthetic resin while the core member is positioned within a powdered mass of the synthetic resin, so that a portion of the powdered mass surrounding the outer surface of the core member is melted and deposited on the outer surace of the core member. To this end, the core member is immersed into the powdered mass of the synthetic resin accommodated in a container. Alternatively, the core member is first placed within the container and the powdered mass of the synthetic resin is introduced into the container, so as to embed the core member in the powdered mass. Subsequently, the metallic core member is induction-heated to a temperature higher than the melting point of the synthetic resin, by energizing a heating coil which is disposed around or within the container.

The above coating method permits formation of a resin layer on the outer surface of the metallic core member in an efficient manner with relatively simple and less costly equipment. The formed resin layer has a degree of adhesion to the metallic core member which is sufficient in actual practice.

However, the applicants found that the above method of forming the metallic core member by heating the core member while it is embedded in the powdered mass is deficient in several respects. More specifically, heat is likely to be transferred from the heated workpiece to the powdered mass, and so the heating of the workpiece requires a relatively long time, which means a relatively long cycle time or relatively low coating efficiency.

Further, the heating of the workpiece while it is embedded within the powdered mass may easily cause voids or pores within a resin layer to be formed on the workpiece. Once air gaps are formed between the surface of the workpiece and the powdered mass, such air gaps seem to prevent the molten resin material from adhering to to the portions of the workpiece surface adjacent to the air gaps. Accordingly, these air gaps tend to be left within the formed resin layer.

Also, it appears that pores are left within the formed resin layer because of substantially simultaneous melting of a relatively large portion of the powdered resin mass adjacent to the workpiece surface. That is, a relatively large molten portion of the powdered mass is simultaneously deposited onto the workpiece surface. This may possibly cause minute spaces between the resin particles to be trapped in the resin layer to be formed on the workpiece surface. It is generally understood that the existence of pores or voids within the formed resin layer is not desirable. This is particularly so if a large number of pores are present at the interface between the workpiece surface and the inner surface of the resin layer. Such pores at the interface reduce adhesion of the resin layer to the workpiece, and consequently lead to flake-off or separation of the resin layer from the workpiece, i.e., from the metal part during its service.

The deficiencies stated above are encountered not only on a metallic core of a lobe-type rotor of a supercharger, but also on other metal parts which are coated with a synthetic resin.

SUMMARY OF THE INVENTION

It is accordingly an object of the present invention to provide an improved method of applying a synthetic resin layer to an outer surface of a metal part, which assures minimum pores left within the resin layer.

Another object of the invention is the provision of such an improved method which ensures maximum adhesion of the resin layer to the metal part.

A further object of the invention is the provision of such an improved method which provides improved efficiency of heating the metal part, and accordingly improved overall coating efficiency.

According to the present invention, there is provided a method of applying a synthetic resin layer to an outer surface of a metal part, which includes the steps of: (a) heating the metal part to a temperature higher than a melting point of a thermally fusible synthetic resin; (b)

embedding the heated metal part within a powdered mass of the synthetic resin, thereby melting a portion of the powdered mass surrounding the outer surface of the heated metal part; (c) holding the heated metal part within the powdered mass for a time period sufficient to permit the molten portion of the powdered mass to be coated on the outer surface of the heated metal part as the synthetic resin layer; (d) removing the metal part coated with the synthetic resin layer from the powdered mass; and (e) maintaining the removed metal part at a temperature higher than the melting point and lower than a thermal decomposition point of the synthetic resin.

In the method of the present invention described above, the heated metal part is immersed in the powdered mass for contact of the outer surface of the metal part with the powdered mass with a relative movement therebetween. With this arrangement, small spaces or air gaps which may be present within the powdered mass will be less likely to remain on specific portions of the outer surface of the metal part. The molten portion of the powdered mass may be deposited first as a thin layer having a uniform thickness over the surface of the metal part, and subsequently the resin layer grows with an increasing thickness. This arrangement ensures minimum voids or pores left at the interface between the surface of the metal part and the resin layer formed thereon. Accordingly, the adhesion of the formed resin layer to the metal part is increased, and the resin layer suffers from a minimum of voids or pores left in its portion outward of the interface with the metal part. Further, since the metal part is heated before it is immersed into the powdered mass, the amount of heat to be transferred from the heated metal part to the powdered mass is significantly reduced, whereby the heating efficiency is improved, and the overall coating cycle time is accordingly shortened.

The instant method further includes the step of maintaining the coated metal part removed from the powdered mass for a suitable time and at a temperature higher than the melting point and lower than the thermal decomposition point of the synthetic resin. In this period, the resin layer formed on the metal part is kept in a molten state, allowing possibly entrapped air in the resin layer to escape into the ambient atmosphere. Hence, the voids or pores left in the formed resin layer are reduced, whereby the adhesive bond between the metal part and the resin layer is consequently increased and the resin layer is given a relatively high density, i.e., a relatively low porosity.

According to one feature of the invention, the molten portion of the powdered mass is deposited while the powdered mass is maintained in a non-fluid state.

According to another feature of the invention, the metal part is induction heated before it is embedded into the powdered mass.

According to a further feature of the invention, the metal part is reheated by induction heating before removing the metal part from the powdered mass.

In accordance with a yet further feature of the invention, the removed metal part is heated in a furnace to maintain the molten state of the resin layer.

The present method is suitably practiced on a core member of a rotor for a rotary fluid machine of a Roots type. In one form of the method, a powder of a copolymer of tetrafluoroethylene and ethylene is used as the thermally fusible synthetic resin.

Where the instant method is practiced on a core member of a rotor for a rotary fluid machine of a Roots type as indicated above, the metal part in the form of the metallic core member is immersed in the powdered mass such that the axis of rotation of the rotor is oriented upright. In this case, a bore or bores which is/are formed through the core member parallel to its axis of rotation and open at its flat opposite end faces are preferably closed at the opposite open ends by suitable closure members, before the core member is immersed in the powdered mass.

BRIEF DESCRIPTION OF THE DRAWINGS

The foregoing and other objects, features and advantages of the present invention will be better understood by reading the following detailed description of a preferred embodiment of the invention, when considered in connection with the accompanying drawings, in which.

DESCRIPTION OF THE PREFERRED EMBODIMENTS

Referring to the accompanying drawings, there will be described the preferred embodiment of the present invention, in which a synthetic resin material is applied to an outer surface of a metal part in the form of a metallic core member of a lobe-type rotor as indicated at 4 in FIG. 5.

Figure 3:
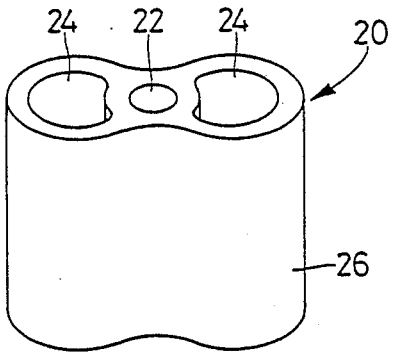
FIG. 3 is a perspective view of the workpiece or metallic part in the form of a metallic core member of a lobe-type rotor.

The metallic core member (hereinafter referred to as "workpiece" as appropriate) is generally indicated at 20 in FIG. 3. The core member 20 has a transverse cross sectional shape similar to the shape of a cocoon or peanut shell, and is made of an aluminum alloy, more precisely, an aluminum-silicon alloy having a silicon content as high as about 12% (according to Japanese Industrial Standards, JIS A 4047, for example). The core member 20 has a central axial bore 22, which defines an axis of rotation of the lobe-type rotor. The core member 20 further has two axial bores 24, 24 which are formed parallel to the central axial bore 22, so as to extend through a pair of lobe portions of the core member 20 on diametrically opposite sides of the central bore 22. These additional bores 24 are provided for reducing the weight of the rotor 4. Each of the bores 22, 24 opens on flat opposite end faces of the core member 20.

According to the present invention, the metallic core member or workpiece 20 is covered with a resin layer. More specifically, the outer peripheral surface and the outer parts of the opposite end faces of the workpiece 20 are coated with a thermally fusible synthetic resin, for example, a powder of AFLON (registered trademark for a copolymer of tetrafloroethylene and ethylene) which is a copolymer of tetrafluoroethylene and ethylene. The outer surface of the workpiece 20 to be coated with such a synthetic resin material is indicated at 26 in FIG. 3.

The outer surface 26 of the workpiece 20 to be covered by a resin layer is preferably pre-treated before the resin material is applied thereto. The outer surface 26 may be pre-treated by degreasing and subsequent water rinsing. For increased adherence of the resin layer to the outer surface 26, however, it is advisable that the pre-treatment comprises: preliminary washing and subsequent drying of the outer surface 26; bombarding particles of hard substances onto the dried outer surface 26 at a high speed, so as to create a multiplicity of concavities in the surface 26; degreasing the surface 26 with an alkalescent degreasing agent; and water rinsing the surface 26 to remove the degreasing agent.

Figure 1:
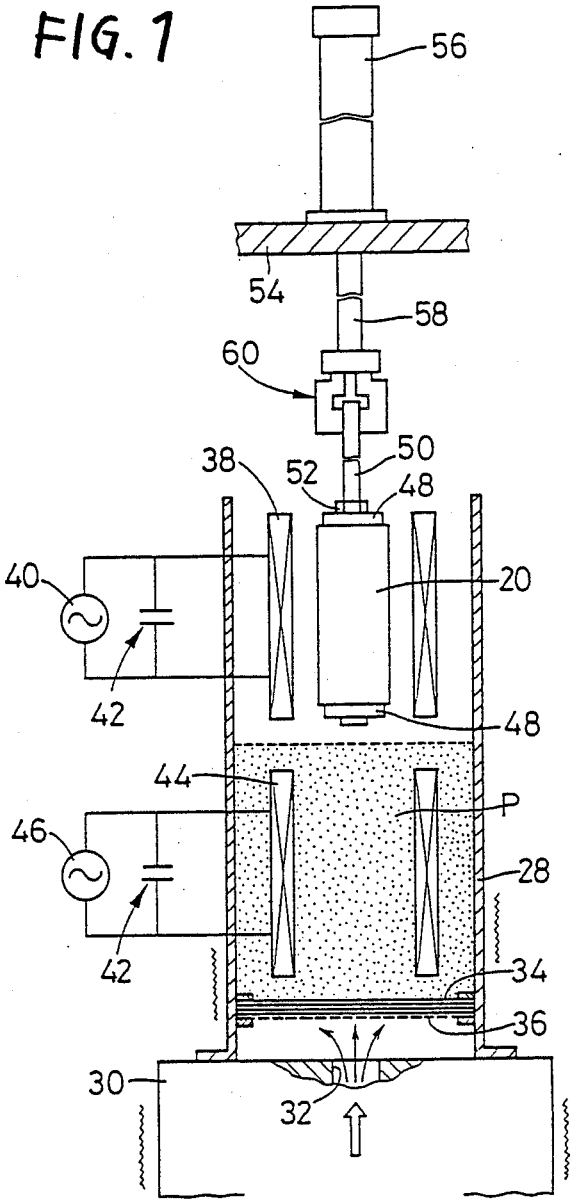
FIG. 1 is a schematic elevational view in cross section of an apparatus adapted to practice a method of the present invention, showing a step of induction-heating a workpiece.

After the workpiece 20 is finally dried, the resin layer is applied to the pre-treated outer surface 26, by an apparatus schematically illustrated in FIG. 1.

In FIG. 1, reference numeral 28 designates a container in which a powdered mass P of AFLON is accommodated. In this modified embodiment, the workpiece 20 is subjected to a preliminary heating step (which will be described), before it is immersed in the powdered mass P maintained in a fluid state. To improve the fluidity of the powdered mass P, the container 28 mounted on an oscillating device 30 is oscillated while compressed air is blown into the powdered mass P through a passage 32 formed in the oscillating device 30 and the bottom of the container 28. The oscillatory movements of the container 28 and the powdered mass P act to reduce friction of the resin particles of the powdered mass P which are supported or levitated by the upward flows of the compressed air through the powdered mass P. Thus, the oscillation of the powdered mass P is combined with the upward flows of the compressed air to enhance the fluidity of the powdered mass P.

Various known oscillators such as a mechanical oscillator using an unbalancing weight may be used as the oscillating device 30. Preferably, the oscillating device 30 is operated at an oscillating frequency within an approximate range of 1800 Hz, and at an acceleration within an approximate range of 2.8 G. The container 28 has a gas-permeable bottom in the form of an air filter 34 for uniform distribution of the air from the passage 32 into the powdered mass P. The air filter 34 must have a texture which is fine enough to avoid a channeling phenomenon in which wide fluid paths are formed in the portions of the powdered mass P at which the flow resistance is comparatively low. In the present embodiment, the air filter 34 consists of a plurality of semi-transparent parchment paper sheets superposed on each other (for example, 15 sheets). The parchment paper is usually used as tracing paper in drafting of drawings. The air filter 34 is supported by a net 36 at the bottom of the container 28. While the air filter 34 is used to form a gas-permeable bottom of the container 28, it is replace the air filter 34 by other gas-permeable members such as a porous plate made of polyethylene or ceramics, or a metallic filter, which permits permeation of a gaseous fluid therethrough, but not of the resin particles.

In an upper half of the container 28 which is not filled with the powdered mass P, an upper induction heating coil 38 for preliminary heating of the workpiece 20 is fixedly disposed. This heating coil 38, which is similar to a coil used for induction hardening, is positioned so as to surround the workpiece 11 when placed in its preliminary heating position of FIG. 1, such that the heating coil 38 is spaced a suitable distance away from the periphery of the workpiece 20. With the upper coil 38 energized by a power supply 40, the workpiece 20 is induction-heated. For an improved power factor of the power supply circuit, a capacitor 42 is provided between the power supply 40 and the coil 38, in parallel connection with the power supply 40. The upper induction heating coil 38 has a coolant passage (not shown) formed therein to circulate a coolant. The coil 38 is mounted on a bracket (not shown) which is supported by a suitable suspension member fixed to a member outside the container 28.

Below the upper induction heating coil 38, a lower induction heating coil 44 is fixedly disposed within the powdered mass P, so that the workpiece 20 immersed or embedded in the powdered mass P is surrounded by the coil 44 and induction-heated when the coil 44 is energized by a power supply 46. Like the upper coil 38, this lower coil 44 is supported by a suitable suspension member such as wires or a bracket. Although the upper and lower coils 38, 44 may be fixed to the container 28 by means of brackets or faceplates, it is desired that the coils 38, 44 be supported by a member other than the container 28, since the container 28 is oscillated by the oscillating device 30.

As noted earlier, closure members 48, 48 are used to close the open ends of the axial bores 24, 24 formed in the workpiece 20. However, a support rod 50 is inserted through the central axial bore 22 in the workpiece 20 such that the head of the rod 50 is in abutment on the lower closure member 48. The closure member 48, 48 and the rod 50 are fixed to the workpiece 20 by tightening a nut 52 which engages an externally threaded portion of the rod 50. The closure members 48, 48 are preferably formed of asbestos mixed with a cement, made of ceramics or other dielectrics and coated with a suitable resin such as tetrafluoroethylene. The rod 50 and the nut 52 are made of brass, stainless steel or other metallic materials which are induction-heated not easily, so that the synthetic resin (AFLON) will not adhere to the rod and nut, 50, 52.

Above the container 28, there is provided a stationary member 54 on which a cylinder 56 is mounted such that its piston rod 58 extends downward toward the container 28. The piston rod 58 carries at its end suitable means for holding the upper end of the support rod 50. For example, the piston rod 58 is equipped with a chuck 60 as illustrated in FIG. 1, or provided at its end with a tapered bore which fits the tapered upper end of the rod 50. In the latter case, a pin or screw is used to maintain the engagement of the tapered end of the rod 50 with the tapered bore of the piston rod 58.

The operation according to the invention of the apparatus of FIG. 1 constructed as described above will now be described, referring further to FIG. 2.

The metal part or workpiece 20 whose outer surface 26 is pre-treated as previously described is supported together with the enclosure members 48, 48, with the support rod 50 connected to the piston rod 58. The cylinder 56 is first activated to hold the workpiece 20 in its preliminary heating position of FIG. 1, at which time the workpiece 20 is surrounded by the upper induction heating coil 38. In this condition, the upper coil 38 is energized to induction-heat the workpiece 20 to a temperature above the melting point of the synthetic resin of the powdered mass P. In the instant case where a copolymer of tetrafluoroethylene and ethylene (AFLON) is used, the workpiece 20 is heated to a temperature higher than the melting point of 260° C. of the AFLON. For a better quality resin layer to be formed, and for higher coating efficiency, it is advisable that the heating temperature of the workpiece 20 is held at a level below the thermal decomposition point of the AFLON, i.e., 360° C., preferably within a range of 300°-340° C., and more preferably in the neighborhood of 340° C. However, the workpiece 20 may be heated to a point just below 360°, as the workpiece 20 is cooled while the workpiece 20 is immersed into the powdered mass P in the subsequent step. The preliminary heating of the workpiece 20 by the upper coil 38 is accomplished, for example, by applying an electric current of about 3KHz to the coil 38 for about 120 seconds. In this case, the workpiece 20 may be heated substantially uniformly at its outer portion, and at its inner portion to some extent.

The workpiece 20 subjected to the preliminary heating by the upper coil 38 is then lowered, by a further downward movement of the piston rod 58, so that the workpiece 20 is embedded within the powdered mass P. This movement of the workpiece 20 into the powdered mass P is facilitated by an oscillatory movement of the powdered mass P via the container 28, and upward air flows into the powdered mass P through the air filter 34. Namely, the workpiece 20 is easily immersed into the powdered mass kept in a fluid state. During the immersion of the workpiece 20 into the powdered mass P, the power supply 46 for the lower coil 44 is held off.

While the workpiece 20 is being immersed into the powdered mass P, the outer surface 26 of the workpiece 20 heated above the melting point of the powdered mass P contacts the powdered mass P with a relative movement therebetween. Consequently, the synthetic resin contacting the outer surface 26 is instantaneously melted and deposited on the surface 26 as a thin molten resin layer, without voids left in the molten resin layer. Even if voids are produced in the molten portion of the powdered mass P adjacent to the outer surface 26, such voids are moved along the surface 26, due to the relative movement of the workpiece 20 relative to the powdered mass P, whereby the voids do not prevent the molten synthetic resin from adhering to specific parts of the outer surface 26.

Figure 2:
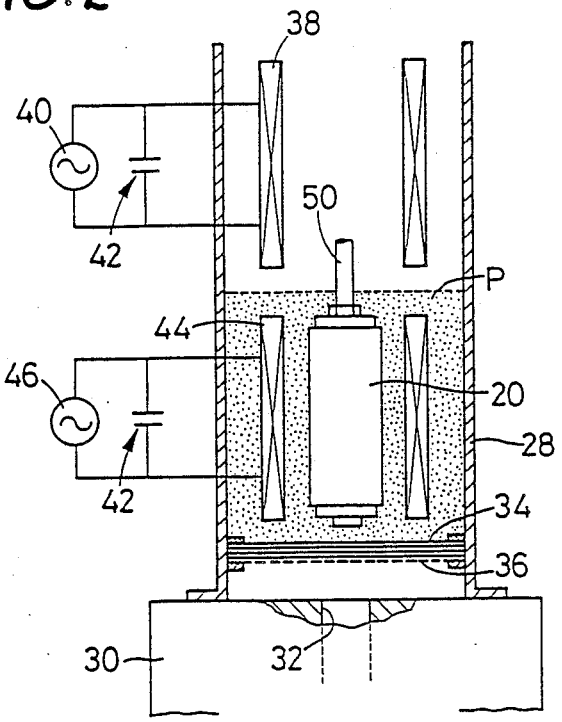
FIG. 2 is a schematic elevational view of the apparatus of FIG. 1, showing a step of applying a resin layer to an outer surface of the workpiece.

By about 20-30 seconds after the start of movement of the workpiece 20 toward the powdered mass P, the workpiece 20 has been completely immersed in the powdered mass P, that is, moved to the position of FIG. 2 at which the workpiece 20 is surrounded by the lower induction heating coil 44. At this time, the oscillating device 30 is turned off, and the air supply from the passage 32 is discontinued. The melting of the synthetic resin adjacent to the workpiece 20 continues in the position of FIG. 2. If the powdered mass P were to be kept in a fluid state at this time, air channels would tend to be formed at the interface of the outer surface 26 and the powdered mass P, which channels would prevent deposition of the molten resin onto the corresponding parts of the surface 26. For this reason, the air blast into the powdered mass P and the oscillation of the container 28 are discontinued when the workpiece 20 has been completely immersed in the powdered mass P.

Figure 4:
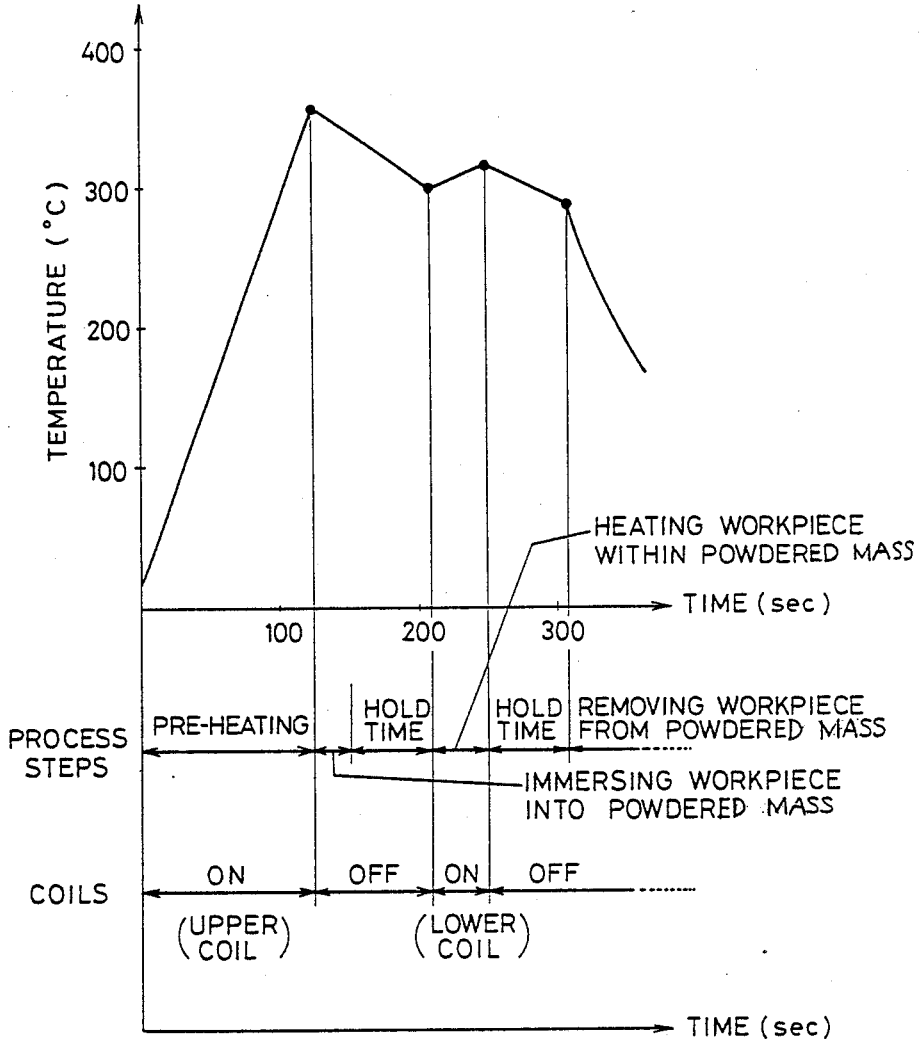
FIG. 4 is a graph showing the different steps of the method, in relation to the temperature of the workpiece varying with the time.

After the workpiece 20 has been fully immersed in the powdered mass P and the powdered mass P has been brought to a non-fluid state, the workpiece 20 is left in the powdered mass P for a suitable time, for example, 60 seconds, without energization of the lower coil 44. In this holding time period, an additional amount of the synthetic resin is melted and deposited on the surface 26 of the workpiece 20, whereby the thickness of the molten resin layer adhering to the surface 26 of the workpiece 20 is gradually increased. While the workpiece 20 is held in the powdered mass P with the lower induction heating coil 44 kept off, the temperature of the workpiece 20 gradually drops, as indicated in FIG. 4. To keep the workpiece 20 at a temperature within a predetermined range, the workpiece 20 is reheated with the power supply 46 turned on when the workpiece 20 has cooled below 300° C., for example. Namely, an induction current of about 3 KHz frequency for example is applied to the lower induction heating coil 44 for a suitable period of time (40 seconds, for example) to re-heat the workpiece 20 up to 320° C., for example, as also indicated in FIG. 4.

Then, the workpiece 20 is left in the powdered mass P for 60 seconds, for example, with the lower coil 44 kept deenergized. With the re-heating of the workpiece 20 and the subsequent hold time, the molten resin layer adhering to the outer surface 26 of the workpiece 20 further develops. In this specific example, the sum of the first holding time prior to the re-heating, the re-heating time and the second holding time subsequent to the re-heating, amounts to about 2-3 minutes. During this time period, the resin layer to be formed is given a thickness of about 1.2 mm. The re-heating time and the holding times are selected so as to obtain a desired thickness of the resin layer. The second holding time following the re-heating time is provided for maximum utilization of the thermal energy given to the workpiece 20 for deposition of the synthetic resin on the workpiece 20. If a reduction in the cycle time is preferred to an increase in thermal efficiency, the workpiece 20 may be taken out of the powdered mass P immediately after the termination of the re-heating step.

The workpiece 20 coated with the resin layer of a desired thickness is then removed from the powdered mass P with the upward movement of the piston rod 58 of the cylinder 56 (FIG. 1). This removal of the workpiece 20 is accomplished while the powdered mass P is kept in a fluid state, as in the step of immersing the workpiece 20 into the powdered mass P. That is, the oscillating device 30 is turned on and the compressed air is supplied through the passage 32, before the cylinder 56 is activated to raise the workpiece 20. In this way, the workpiece 20 is easily removed from the powdered mass P.

The thus formed resin layer has a minimum of voids or pores and comparativey high adhesion to the surface of the metallic core member 20, assuring improved quality of the lobe-type rotor. However, for further improvement of the lobe-type rotor, the workpiece or the metallic core member 20 coated with the resin layer is maintained at a temperature higher than the melting point and lower than the thermal decomposition point of the synthetic resin.

Stated in greater detail, the removed workpiece 20 is introduced into a furnace which has a suitable heat source such as an electric heater or combustion gas heater. The workpiece 20 is maintained in the furnace for about 15-25 minutes at a temperature between 300°-340° C. In this condition, the resin layer formed on the workpiece 20 is held in a molten state, allowing possibly entrapped air to escape from the resin layer.

Thus, this step of maintaining the resin layer in a molten state results in an increased adhesive force between the resin layer and the workpiece 20 and a reduced porosity of the resin layer, which contributes to further improvement in the quality of the resin layer.

The escape of air from the structure of the resin within the furnace has been confirmed by an experiment in which a heat-resistant tape was applied to a portion of the surface of the resin layer to test the degree of removal of air from the resin layer in the furnace. The experiment revealed the fact that a number of concavities were formed on the portion of the resin layer covered by the tape, due to air entrapped between the tape-covered portion of the resin layer and the tape.

As previously described, the illustrated method according to the invention includes a preliminary heating step for heating the workpiece or metallic core member to a temperature higher than the melting point of the synthetic resin, before embedding the workpiece in the powdered mass P, and maintaining the removed workpiece having the resin layer coated thereon at a temperature between the melting and thermal decomposition points of the synthetic resin, for a comparatively long period of time. Comparative tests have shown an advantage of the present method over a conventional method. Namely, an experiment was conducted according to the conventional method, wherein a workpiece was first embedded in a powdered resin mass, and then induction-heated within the resin mass, but the removed workpiece coated with a resin layer was not maintained at an elevated temperature to hold the formed resin layer in a molten state.

A comparative sample was thus prepared. This comparative sample, and the workpiece 20 coated with the resin layer according to the invention were subjected to flake-off or peel-off tests in which the resin layer on the workpiece, after the workpiece had cooled to the ambient temperature, was stripped or peeled off the workpiece with a stripper tool whose tip has a chamfer of about 0.2 mm. The stipper tool was first held in abutment with the end face of the resin layer, and moved relative to the workpiece, parallel to the surface of the workpiece, so as to peel the resin layer off the workpiece. During this peel-off movement of the stripper tool, an adhesive force of the resin layer with respect to the workpiece was measured. The resin layer formed according to the invention exhibited an adhesive force of 50 kg, while the resin layer of the comparative sample demonstrated an adhesive force of 20 kg. Further, the surfaces of the resin layers which had adhered to the workpieces were observed with a microscope. The observation revealed substantially no voids or pores on the surface of the resin layer formed according to the invention, but a large number of voids or pores on the surface of the resin layer of the comparative sample.

Another sample was prepared according to a comparative method in which a workpiece was subjected to a preliminary heating prior to being embedded into the powdered resin mass, but the resin layer on the workpiece removed from the resin mass was not maintained in a molten state. This comparative sample showed an adhesive force of 30 kg. Judging from the above facts, it will be understood that a step of maintaining the formed resin layer on the removed workpiece in a molten state for a suitable time is significantly conducive to an increase in the adhesive force of the resin layer.

For obtaining sufficient results, the length of time for which the formed resin layer is held in a molten state outside the powdered mass is preferably not shorter than 10 minutes, and more preferably not shorter than 15 minutes. While the voids or pores left within the resin layer are reduced with an increase in the above time, this duration is limited from the standpoint of dimensional accuracy of the resin layer which is lowered as the time is increased. For instance, if the coated workpiece is held at 340° C. for more than 40 minutes, the resin layer is subject to undesirable flows which cause dimensional inaccuracy.

It is possible that the power supply 46 is turned on to energize the lower induction heating coil 44 for re-heating the workpiece 20, upon initiation of immersion of the workpiece 20, or immediately after the completion of the immersion, in order to maintain the workpiece 20 substantially at the predetermined temperature.

Further, only one of the air blast into the powdered mass P or only the oscillation of the container 28 by the oscillating device 30 may be used to keep the powdered mass P in a fluid state. However, it is preferable to use both the air blast and the oscillation, in view of problems that are encountered if only one of the above two means is utilized for improving the fluidity of the powdered mass P. Described in more detail, the inner portion of the powdered mass P is difficult to be sufficiently oscillated by the oscillating device 30 without the air blast into the powdered mass P. On the other hand, the air blast tends to cause air channeling paths in the portions of the powdered mass P having a relatively low resistance to the air flow, if the powdered mass P is not oscillated.

Although the illustrated apparatus of FIGS. 1 and 2 uses two induction heating coils in the form of the upper and lower coils 38, 44, the apparatus may be provided with a single coil which is adapted to be movable between an upper position for effecting the preliminary heating and the second re-heating, and a lower position for effecting the re-heating of the workpiece within the powdered mass.

While the illustrated embodiment is adapted to move the workpiece 20 into the powdered mass 42 contained in the stationary container 30 or 58, it is possible that the container is adapted to be movable relative to the workpiece 11 held at a fixed position.

Another alternative method for placing the workpiece 20 within the powdered mass P comprises the steps of positioning the workpiece 20 in an empty container, and filling the container with a powdered mass of a synthetic resin material so as to embed the workpiece 20 in the powdered mass.

Figure 5:
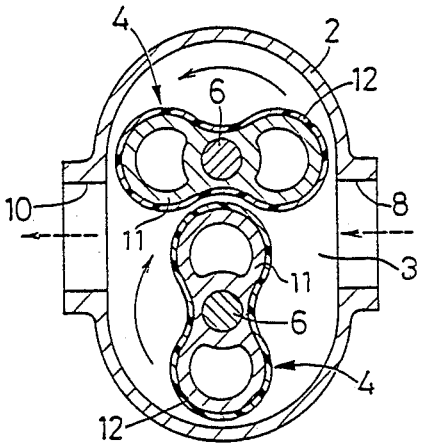
FIG. 5 is an elevational view in cross section of an example of a rotary fluid machine of a Roots type in the form of a supercharger using lobe-type rotors, to which the present invention is applicable.

In the illustrated embodiment, the workpiece 20 (metallic core member of a lobe-type rotor as indicated at 4 in FIG. 5) is made of an aluminum alloy as previously described. However, the principle of the present invention is also applicable to a workpiece made of other materials such as steel. When the workpiece is an aluminum part, i.e., has a relatively small thermal capacity an is easily cooled, the previously described re-heating step is desired. However, when the workpiece is a steel part which is difficult to be cooled, the re-heating step is not always necessary. The re-heating step is also unnecessary when the desired thickness of a resin layer to be formed is relatively small. Further, the heating of the workpiece 20 outside the powdered mass P may be made by other heating means or methods, such as those utilizing the principles of radiation, convection or conduction of heat, for example, by an electric heater, or a furnace utilizing combustion heat.

While the illustrated embodiment uses as a synthetic resin material a fluorethylene resin (such as AFLON which is a copolymber of tetrafluoroethylene and ethylene), the principle of the present invention may be practiced not only with other thermoplastic resin materials such as nylon and polyethylene, but also with thermosetting resin.

Although the workpiece 20 handled in the illustrated embodiment is a metallic core member of a lobe-type rotor of a rotary pump of a Roots type, the method and apparatus of the invention may be adapted to handle other types of metallic rotors for Roots-type or other rotary fluid machines, or other kinds of metallic workpieces.

While the present invention has been described in its preferred embodiment with a certain degree of particularity, it is to be understood that the invention is by no means confined to the precise details of the illustrated embodiments, but may be embodied with various other changes, modifications and improvements which may occur to those skilled in the art, without departing from the spirit and scope of the invention defined in the appended claims.

WHAT IS CLAIMED IS:

1. A method of applying a synthetic resin layer to an outer surface of a metal plate, comprising the steps of:

heating said metal part to a temperature higher than a melting point of a thermally fusible synthetic resin;

subsequently embedding the heated metal part within a powdered mass of said synthetic resin, thereby melting a portion of said powdered mass surrounding said outer surface of said heated metal part;

holding said heated metal part with said powdered mass for a first time period sufficient to permit the molten portion of said powdered mass to be coated on said outer surface of said heated metal part as said synthetic resin layer;

removing said metal part, coated with said synthetic resin layer, from said powdered mass; and maintaining the removed metal part at a temperature higher than said melting point and lower than a thermal decomposition point of said synthetic resin, for a second time period sufficient for air to escape from said synthetic resin coating and for preventing flow of said resin coating, said second time period being between 10 and 40 minutes, wherein said step of embedding the heated metal part within said powdered mass comprises immersing said metal part in said powdered mass while maintaining said powdered mass in a fluid state, and wherein said step of holding said heated metal part within said powdered mass includes maintaining said powdered mass in a non-fluid state.

2. A method according to claim 1, wherein said step of heating said metal part comprises induction-heating said metal part.

3. A method according to claim 1, further comprising the step of re-heating said metal part by induction heating before removing said metal part from said powdered mass.

4. A method according to claim 1, wherein said step of maintaining the removed metal part comprises heating said removed metal part in a furnace.

5. A method according to claim 1, wherein said metal part comprises a core member of a rotor for a rotary fluid machine of a Roots type, and said synthetic resin consists essentially of a powder of a copolymer of tetrafluoroethylene and ethylene.

6. A method according to claim 1, wherein said metal part comprises a core member of a rotor for a rotary fluid machine of a Roots type, said rotor having an axis of rotation and flat opposite end faces which are perpendicular to said axis of rotation, and wherein said step of embedding the heated metal part within said powdered mass comprises immersing said core member in said powdered mass such that said axis of rotation is oriented vertically.

7. A method according to claim 6, wherein said said core member has at least one bore formed therethrough parallel to said axis of rotation, said bore opening into said flat opposite end faces, and which further comprises the step of closing opposite open ends of said at least one bore with closure means before embedding said core member in said powdered mass.

8. A method according to claim 1, wherein said second time period is within a range between 15 and 25 minutes.

9. A method according to claim 1, wherein said second time period is determined independently of said first time period.

10. A method according to claim 1, wherein said thermally fusible synthetic resin is a copolymer of tetrafluoroethylene and ethylene, and wherein said synthetic resin, said temperature to which the metal part is heated before the embedding thereof within said powdered mass, said temperature at which the metal part is maintained after the removal thereof from said powdered mass, and said first and second time periods, are selected so as to give said synthetic resin layer a force of adhesion of at least 50 kg to said outer surface of the metal part.

11. The method according to claim 1, wherein said second time period is between 15 and 25 minutes and said metal part is maintained at a temperature of between 300° and 340° C. during said second time period.

12. A method according to claim 11, wherein said synthetic resin is a copolymer of tetrafluoroethylene and ethylene.

13. A process according to claim 12, wherein said step of maintaining the removed metal part at a temperature higher than said melting point and lower than a thermal decomposition point of said synthetic resin is provided in a furnace.

* * * * *

UNITED STATES PATENT AND TRADEMARK OFFICE

CERTIFICATE OF CORRECTION

PATENT NO. : 4,911,949

DATED : MAY 27, 1990

INVENTOR(S) : TAKAHIRO IWASE ET AL.

It is certified that error appears in the above-identified patent and that said Letters Patent is hereby corrected as shown below:

In the title, on the title page, delete "ELEMINATE" and insert --ELIMINATE--;

In the title of Column 1, delete "ELEMINATE" and insert --ELIMINATE--.

Signed and Sealed this

Twenty-fourth Day of September, 1991

*Attest:*

HARRY F. MANBECK, JR.

*Attesting Officer*

*Commissioner of Patents and Trademarks*